US008333377B2

(12) United States Patent
Kohyama

(10) Patent No.: US 8,333,377 B2
(45) Date of Patent: Dec. 18, 2012

(54) PAPER EJECTOR UNIT

(75) Inventor: Takuro Kohyama, Nishitokyo (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 15 days.

(21) Appl. No.: 12/914,090

(22) Filed: Oct. 28, 2010

(65) Prior Publication Data

US 2011/0101602 A1 May 5, 2011

(30) Foreign Application Priority Data

Nov. 4, 2009 (JP) ..... 2009-253252

(51) Int. Cl.
*B65H 29/00* (2006.01)

(52) U.S. Cl. ..... 271/279; 271/225; 271/902; 400/621

(58) Field of Classification Search ..... 271/225, 271/314, 279, 298, 301, 902, 242; 400/611, 400/621

See application file for complete search history.

(56) References Cited

U.S. PATENT DOCUMENTS 5,588,762 A * 12/1996 Suzuki ..... 400/582
5,649,776 A * 7/1997 Sugimoto et al. ..... 400/617
6,056,460 A * 5/2000 Suzuki ..... 400/621
6,428,226 B1 8/2002 Suzuki et al.
7,420,578 B2 * 9/2008 Kohira ..... 347/197
2001/0022427 A1 * 9/2001 Ito ..... 271/272
2002/0020962 A1 * 2/2002 Takeda ..... 271/314
2006/0153624 A1 * 7/2006 Maeda et al. ..... 400/636
2007/0296144 A1 * 12/2007 Dobrindt ..... 271/306
2009/0232576 A1 * 9/2009 Kohyama ..... 400/621

FOREIGN PATENT DOCUMENTS

JP 11-123850 5/1999

* cited by examiner

*Primary Examiner* — Jeremy R Severson
(74) *Attorney, Agent, or Firm* — Wenderoth, Lind & Ponack, L.L.P.

(57) ABSTRACT

A paper ejector unit includes a paper path having a first path, a second path provided in a lower position than the first path, and a guide provided between the first and second paths and including an inclined face to restrict an upward deflection of the paper in transporting the paper forward to the exit slot. An opening is formed downward at a forward back end of the second, and a reversible transportation roller assembly is in the middle of the second path, configured to be rotated forward to transport the paper forward to the exit slot, to stop rotating to stop transporting the paper, and to be reversely rotated to withdraw the paper having been transported to the exit slot. A third path branches downward from the second path and is provided near a forward upstream side of the reversible transportation roller assembly in order to recover the paper.

14 Claims, 10 Drawing Sheets

PAPER EJECTOR UNIT

CROSS REFERENCE TO RELATED APPLICATION

The present application is based on and claims priority from Japanese Patent Application No. 2009-253252, flied on Nov. 4, 2009, the disclosure of which is hereby incorporated by reference in its entirety.

BACKGROUND OF THE INVENTION

1. Field of the Invention

The present invention relates to a paper ejector unit and particularly to an improved mechanism which is configured to temporarily hold a paper inside the unit before ejecting it from an exit slot, and to retreat and recover the ejected paper from the exit slot under a certain condition.

2. Description of the Prior Art

Generally, a printer issuing printed paper sheets such as tickets, coupons, or receipts includes a paper ejector unit (presenter unit) to eject the printed paper sheets to outside.

Such a paper ejector unit is configured to print certain information on a paper such as a roll paper, cut the printed portion in a proper length and eject it from the exit slot to the outside. A problem with the unit arises when a tip (front end when transported forward) of the printed sheet protrudes from the exit slot before it is cut off. A user may mistakenly consider this completion of printing and pull the tip of the sheet out of the exit slot by force.

In view of solving the above problem, a prior art paper ejector unit is configured not to allow the tip end of the paper to protrude from the exit slot until printing and cutting are completed.

Japanese Patent Application Publication No. 11-123850 discloses such a paper ejector unit which temporarily retains a paper portion in a warped state until printing and cutting are completed. This can prevent a limitation to downsizing of the device by the size of the paper unlike retaining the paper in a spread state inside the device.

The device in the above document can be downsized by compactly retaining a paper portion in a warped state.

However, there still remains a problem with the above device which comprises a movable guide to switch opening/closing of a space to retain the warped portion and a paper path.

That is, during normal paper transport, the guide is switched to close to guide the paper to the path while, for temporarily retaining the paper in the space, it is switched to open to guide the paper to the space. Thus, the movable guide complicates the structure of the device.

SUMMARY OF THE INVENTION

The present invention aims to provide a paper ejector unit which can selectively switch paper transport and temporary retainment of a paper without a movable guide.

According to one aspect of the present invention, a paper ejector unit transports a printed paper to an exit slot along a paper path, in which the paper path comprises a first path, a second path provided in a lower position than the first path, and a guide provided between the first and second paths and including an inclined face to restrict an upward deflection of the paper when the paper is transported forward to the exit slot. An opening is formed downward at a forward back end of the second path; and a reversible transportation roller assembly is provided in the middle of the second path, configured to be rotated forward to transport the paper forward to the exit slot, to stop rotating to stop transporting the paper, and to be reversely rotated to withdraw the paper having been transported to the exit slot. A third path branches downward from the second path and is provided in the vicinity of a forward upstream side of the reversible transportation roller assembly in order to recover the paper.

DETAILED DESCRIPTION OF THE PREFERRED EMBODIMENTS

Hereinafter, embodiments of a paper ejector unit according to the present invention will be described in detail with reference to the accompanying drawings.

First Embodiment

Figure 1:
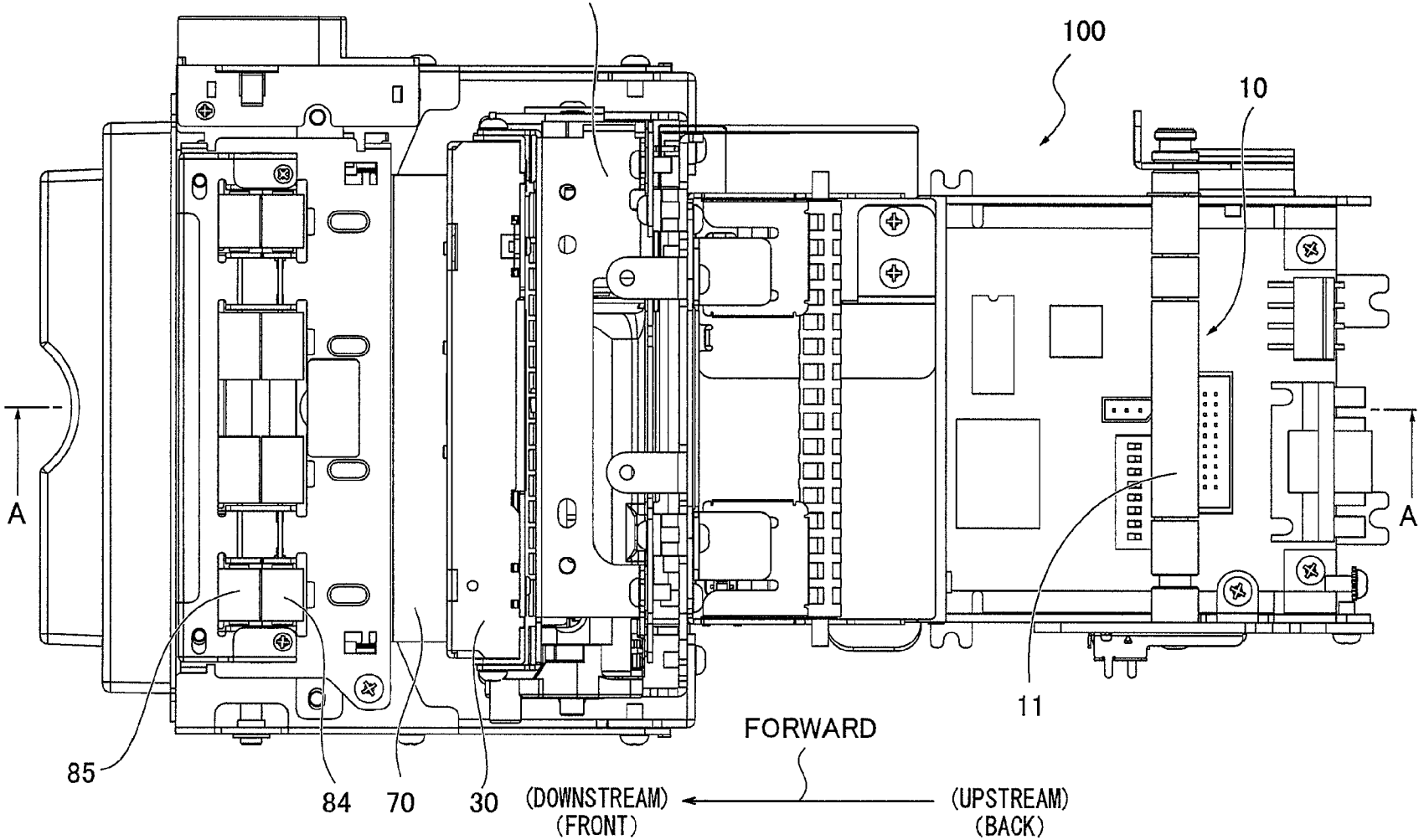
FIG. 1 is a plan view of a paper ejector unit according to a first embodiment of the present invention.
Figure 2:
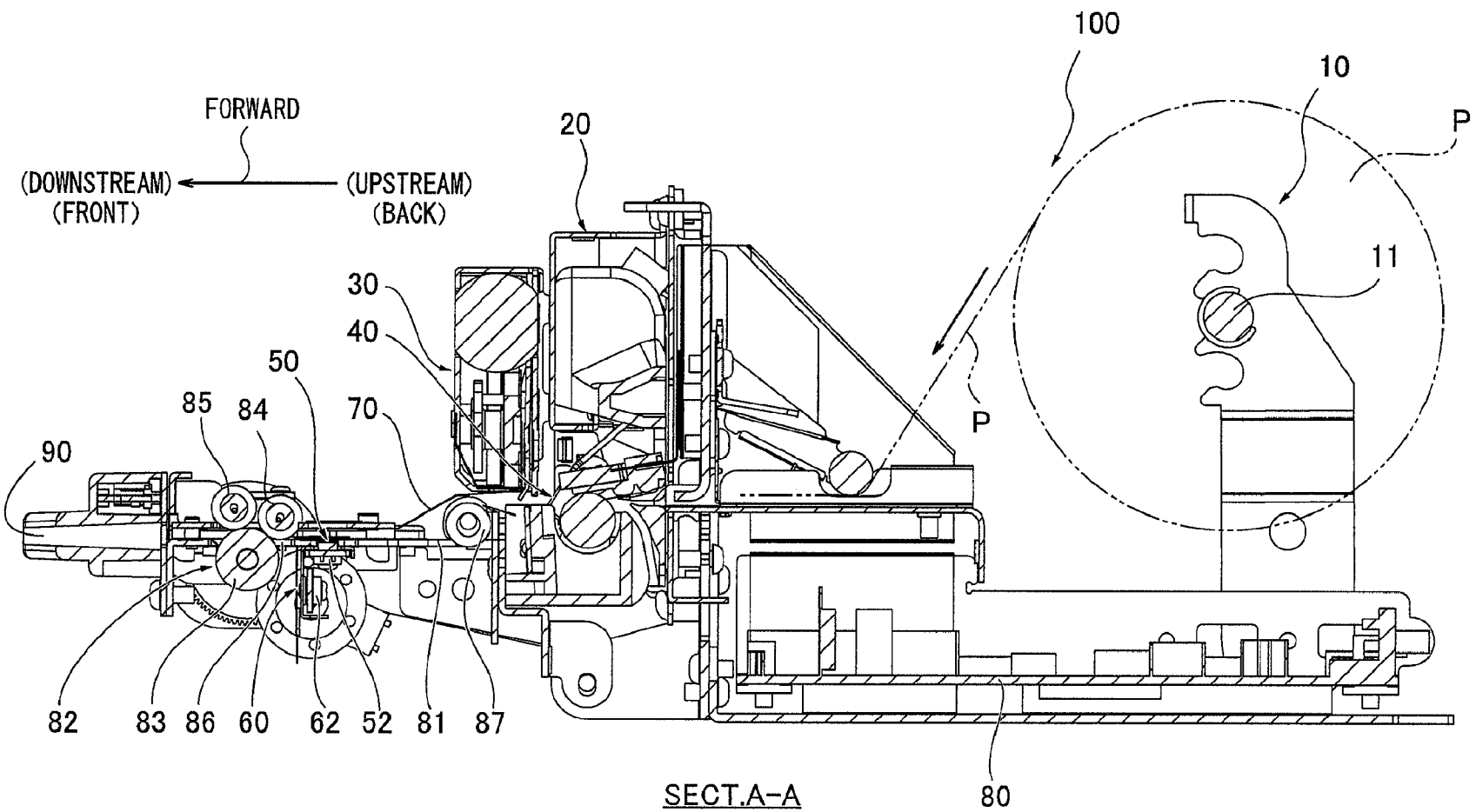
FIG. 2 is a cross section view of the paper ejector unit of FIG. 1 along the A to A line.

FIG. 1 is a plan view of a paper ejector unit 100 according to a first embodiment, and FIG. 2 is a cross section view of the same of FIG. 1 along the A to A line.

The paper ejector unit 100 is configured to print predetermined information (including text, graphics, and other data) on a portion of a long-length roll paper P, cut the printed portion in a predetermined length, and eject the cut portion outside through an exit slot 90. It comprises a paper holder 10 rotatably supporting the roll paper P, a horizontally extending first path 40, on which an end of the paper P is transported forward to the exit slot 90, a printer 20 provided in the middle of the first path 40 to print data on the paper P transported therealong, a cutter 30 provided in the middle of the first path 40 and further downstream in the forward direction than the printer 20 to cut the paper P in a predetermined length, a second path 50 provided at a lower position than the first path 40 and substantially parallel (horizontal) to the first path 40, a guide 70 provided between the first and second paths 40, 50 and having an inclined face to restrict the paper P from deflecting upward, and a third path 60 branching downward from the second path 50 to recover the paper P. It also comprises an opening 81 at the forward back end of the second path 50, and a reversible transportation roller assembly 82 provided in the middle of the second path 50 to be rotated to transport the paper P forward to the exit slot 90, to be reversely rotated to withdraw the paper P having been transported to the exit slot 90, and to stop rotating to stop transporting the paper P. The third path 60 branches downward from the second path 50 and is provided in the vicinity of a forward upstream side of the reversible transportation roller assembly 82.

Paper sensors 52, 62 (photo reflector or the like, for example) are provided on the second path 50 and the third path 60, respectively, to detect the paper P passing thereon.

Moreover, the paper ejector unit 100 comprises a drive controller 80 which is incorporated in a control board disposed under the paper holder 10 to selectively switch the rotation of the reversible transportation roller assembly 82 in accordance with one of the following conditions (1) to (3), as shown in FIG. 2.

(1) A state of the paper P detected by the paper sensors 52, 62

(2) Predetermined conditions such as an elapse of a predetermined period (3) A state of the paper P detected by the paper sensors 52, 62 and predetermined conditions such as an elapse of a predetermined period The control board is provided to perform various controls over the respective elements of the paper ejector unit 100, such as power supply to a not-shown power source, the printer 20, cutter 30 and paper sensors 52, 62.

Further, the drive controller 80 does not have to be a part of the control board, or it does not need to be configured independently from the reversible transportation roller assembly 82. It can be incorporated in the reversible transportation roller assembly 82, for example.

The paper holder 10 includes a shaft 11 extending in the width direction of the paper ejector unit 100 as shown in FIG. 1. The shaft 11 is inserted through the core of the roll paper P to rotatably support the paper P.

The second path 50 includes a gap as an opening 86 between the third path 60 and in the vicinity of the forward upstream of the reversible transportation roller assembly 82.

The first to third paths 40, 50, 60 and the guide 70 constitute a paper path of the paper ejector unit 100 as a whole.

In the present embodiment the printer 20 is a thermal printer; however, it is not limited thereto. It can be a dot-impact type or ink-jet type printer.

Further, the forward back end of the second path 50 refers to an upstream end thereof when the paper P is transported forward, and to a downstream end when the paper P is transported backward. The backward back end refers to a downstream end (forward front end) when the paper P is transported forward.

The vicinity of the forward upstream side of the reversible transportation roller assembly 82 refers to an adjacent region of the upstream side of the reversible transportation roller assembly 82 when the paper P is transported forward.

Further, a feed roller 87 is provided at the forward front end of the first path 40 and more downstream than the cutter 30 to transport the paper P forward. The opening 81 is formed in the vicinity of the forward downstream of the feed roller 87.

Figure 3:
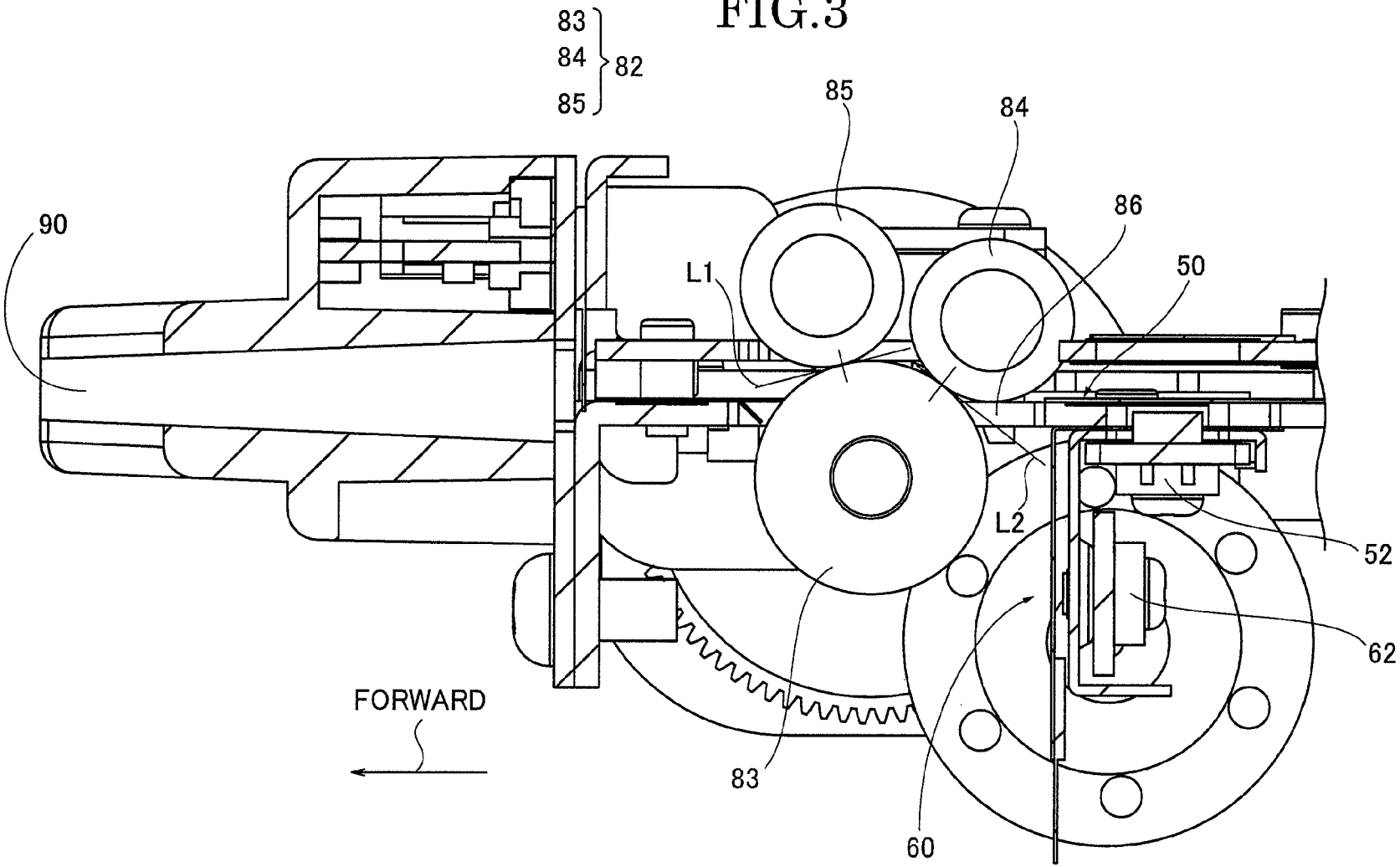
FIG. 3 is a detailed cross section view of a reversible transportation roller assembly.

The reversible transportation roller assembly 82 on the second path 50 comprises a first roller 83 as a drive roller to contact the bottom face of the paper P having been transported on the second path 50. The reversible transportation roller assembly 82 further comprises a second roller 84 and a third roller 85 as driven rollers smaller in diameter than the first roller 83 to contact with the top face of the paper P. The third roller 85 is disposed more downstream than the second roller 84 in the forward direction. The first and third rollers 83, 85 are positioned so that the forward downstream end of a common tangent line L1 of the rollers 83, 85 faces the exit slot 90. The first and second rollers 83, 84 are positioned so that the forward upstream end of a common tangent line L2 of the rollers 83, 84 is inclined to the third path 60, as shown in detail in FIG. 3.

Figure 4:
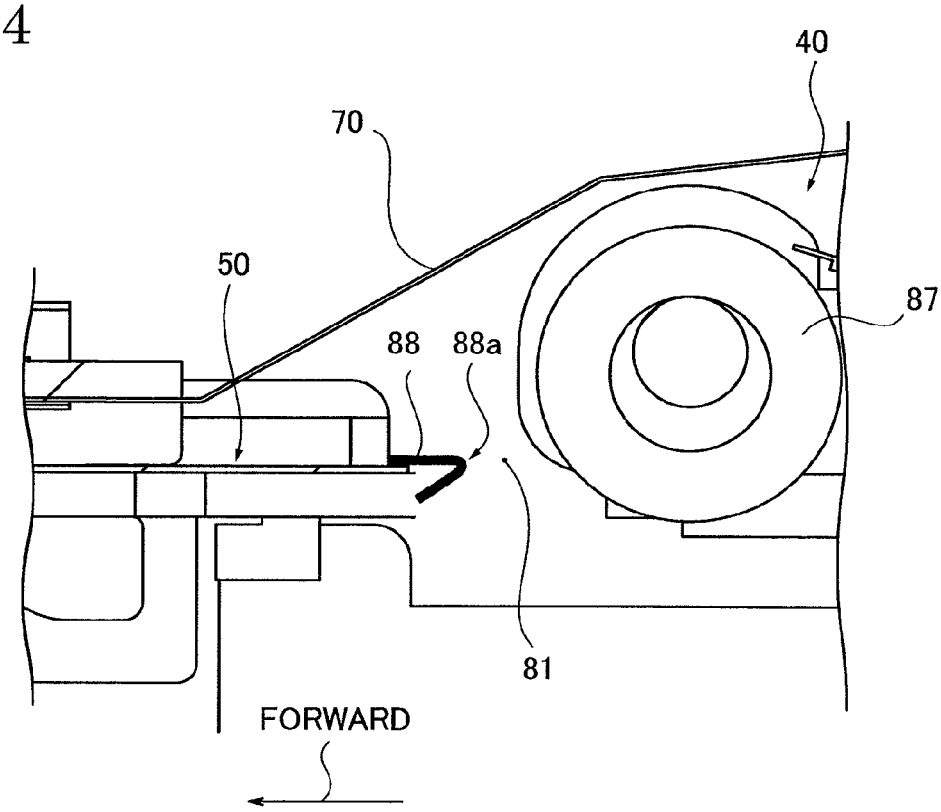
FIG. 4 is a detailed view of a friction reduction part.

Also, a friction reduction part 88 (see FIGS. 4 and 5) is provided in a periphery of the forward back end of the second path 50, that is, a forward downstream edge of the opening 81, to reduce friction occurring between the periphery and the paper P sliding with the periphery at an inclined angle.

The friction reduction part 88 extends in a forward upstream direction from the forward back end of the second path, and is made of a thin resin plate whose forward back end 88*a* is bent downward to have an arc-like curvature R. Having the curvature R, it can reduce friction to the sliding paper P, compared with a simply cut edge. Note that friction between the plan surface of the resin plate constituting the friction reduction part 88 and the paper P is more reduced than that between the surface of the second path 50 and the paper P.

Next, the action of the paper ejector unit 100 according to the present embodiment is described.

The shaft 11 of the paper holder 10 is inserted into the core of the roll paper P to support the paper P. First, an end of the outermost portion is pulled out of the roll paper P and transported forward on the first path 40.

Figure 5:
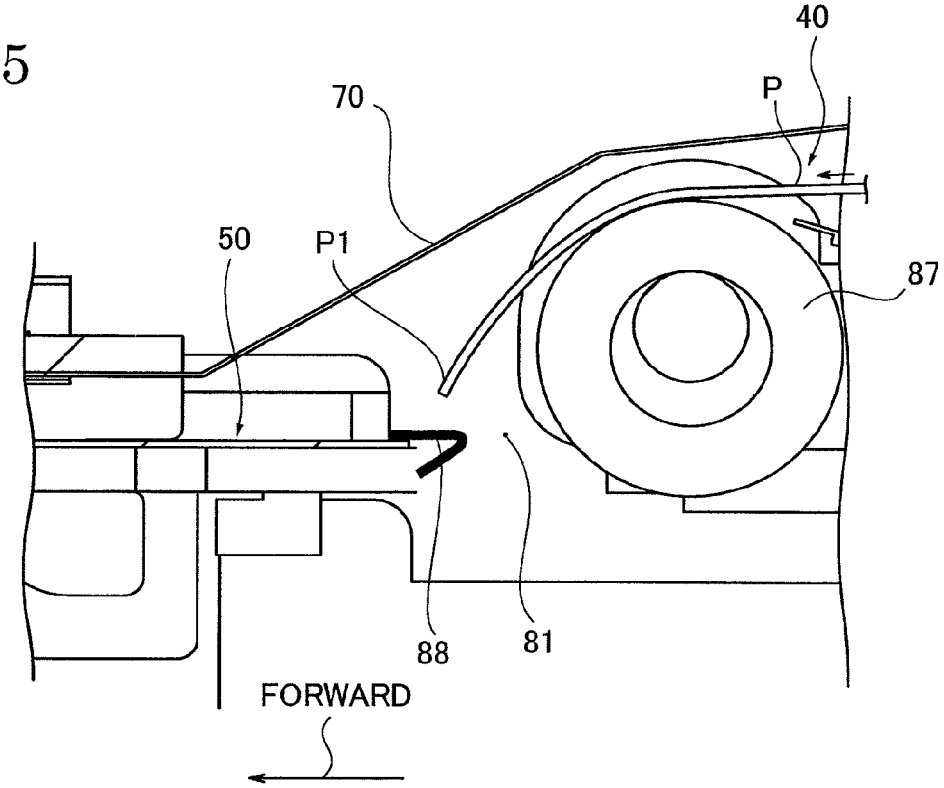
FIG. 5 shows the front end of a paper during forward transport from a first path to a second path.
Figure 6:
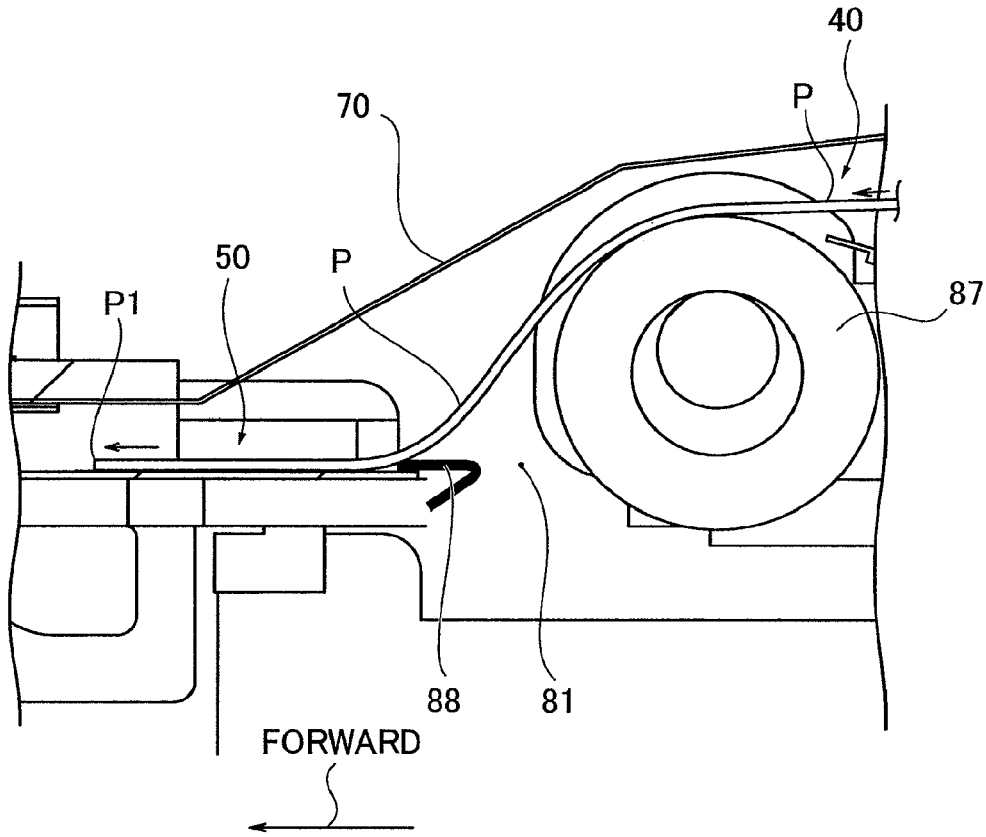
FIG. 6 shows the front end of the paper having been transported forward to the second path from the first path.

Then, predetermined information is printed by the printer 20 on a portion of the paper P which is transported to the first path 40, the printed portion passes through the cutter 30 and is transported forward by the feed roller 87 provided at the forward front end of the first path 40, as shown in FIG. 5. The front end P1 of the paper P hits the top face of the friction reduction part 88 at the back end of the second path 50 which is at a lower position than the first path 40. Then, it is forwarded along the second path 50 as shown in FIG. 6.

Figure 7:
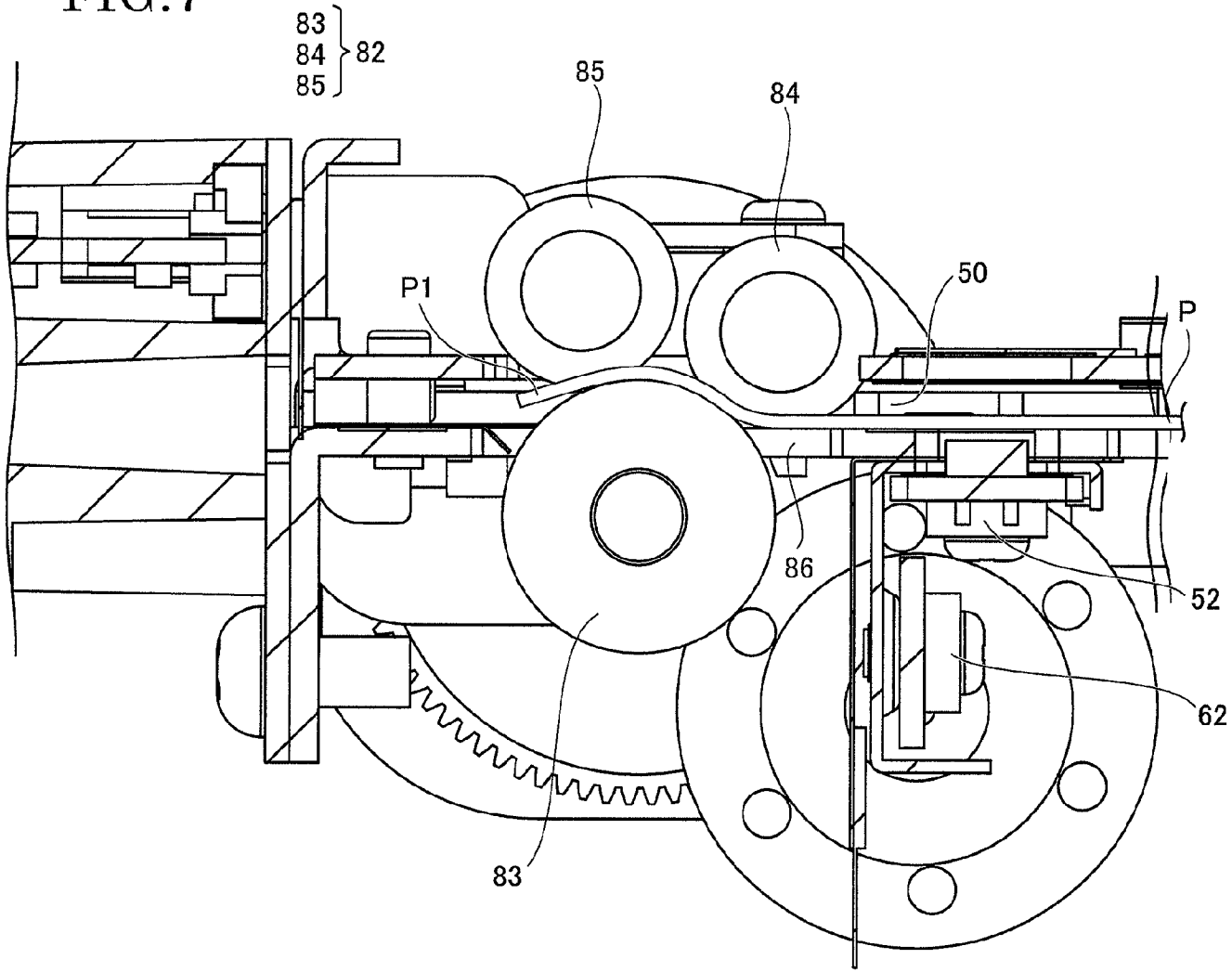
FIG. 7 shows the front end of the paper having been transported forward to the reversible transportation roller assembly.

In FIG. 7, when the front end P1 of the paper P reaches the reversible transportation roller assembly 82 in the middle of the second path 50 and is held thereby, the drive controller 80 controls the reversible transportation roller assembly 82 to stop rotating. Note that in the present embodiment, the drive controller 80 is configured to control the reversible transportation roller assembly 82 to stop by a program in a predetermined period after the front end P1 of the paper P is detected on the second path 50 by the paper sensor 52, for example. However, a control over the reversible transportation roller assembly 82 of the paper ejector unit according to the present embodiment is not limited to the above. Other various control systems or methods are applicable thereto.

Figure 8:
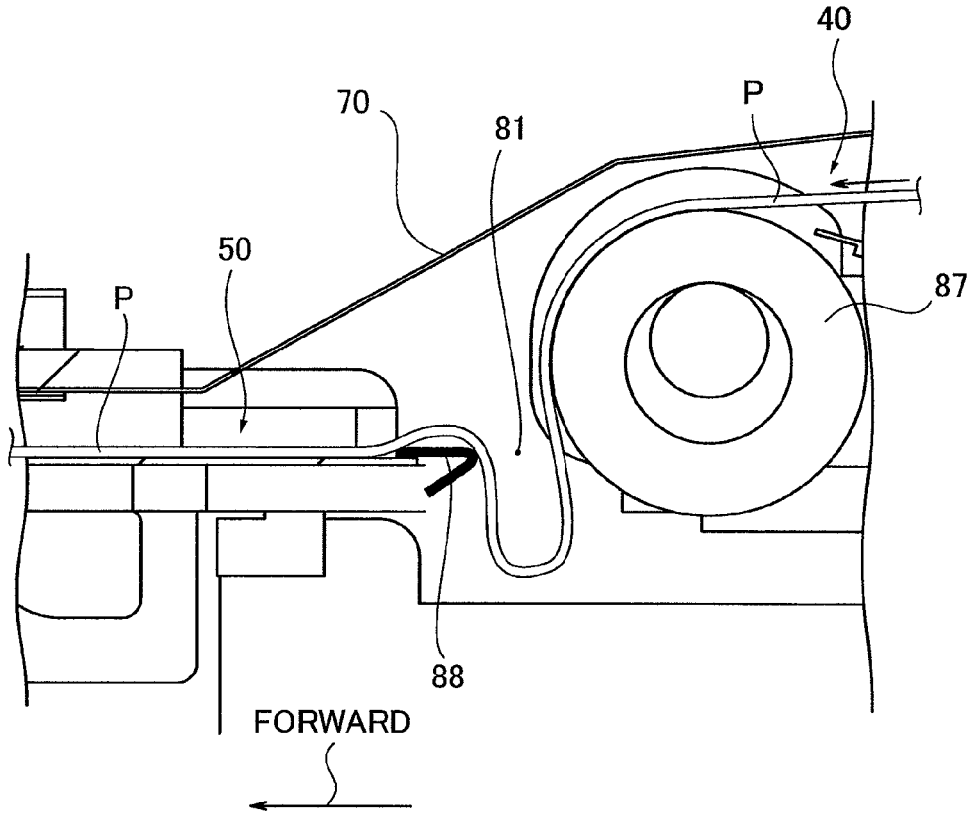
FIG. 8 shows a loop-down portion paper temporarily retained in an opening when the forward front end of the paper is supported by the reversible transportation roller assembly.

While the front end P1 is stopped as described above, the feed roller 87 continuously transports the paper P forward. This causes a portion of the paper P upstream of the reversible transportation roller assembly 82 to start deflecting. Restricted from moving upward by the inclined face of the guide 70, the portion of the paper P is looped down in the opening 81 as shown in FIG. 8. This accordingly makes it possible to prevent the front end P1 of the paper P from protruding from the exit slot 90 even when a printed portion is very long, and temporarily retain it inside the paper ejector unit 100.

Figure 9:
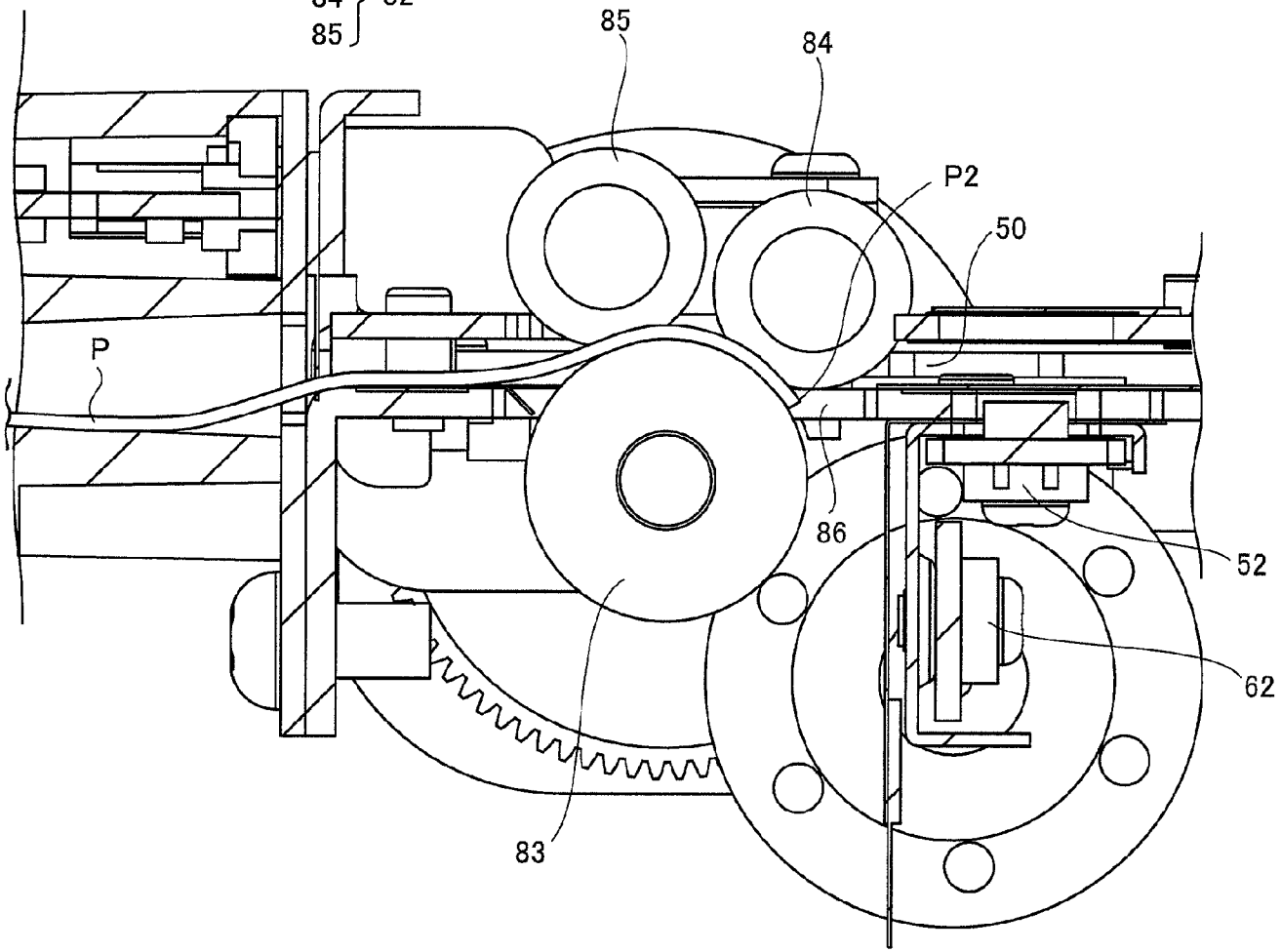
FIG. 9 shows the back end of a cut paper portion stopping near downstream of the reversible transportation roller assembly when the front end of the cut paper portion protrudes from an exit slot.

Meanwhile, the drive controller 80 controls the reversible transportation roller assembly 82 to resume forwarding the paper P when a predetermined condition in which the printed portion of the paper P is cut by the cutter 30 is satisfied, for example. The front end P1 of the portion is transported on the second path 50 toward the exit slot 90, or the common tangent line L1 of the first and third rollers 83, 85. Along with the transportation, the loop-down is eliminated as in FIG. 6 and the cut portion is integrally transported forward on the second path 50. Then, the front end P1 protrudes from the exit slot 90. The back end P2 of the cut portion is held between the first and second rollers 83, 84 of the reversible transportation roller assembly 82 as shown in FIG. 9.

While the loop-down is eliminated, the bottom face of the loop-down portion slides with a back end 88*a* of the friction reduction part 88 provided at the back end of the second path 50. A large friction caused by the sliding may cause a paper jam or a scratch on the paper P. However, according to the paper ejector unit 100 of the present embodiment, the friction reduction part 88 comprises the curvature R at the back end 88*a* to contact with the bottom face of the paper P, thereby substantially reducing the friction to the paper P compared with a simply cut edge. Accordingly, it is possible to prevent the paper P from being scratched and hanging over the edge of an element (back end 88*a* of the friction reduction part 88 in the present embodiment) when pulled up from the opening 81.

Moreover, the paper ejector unit 100 comprises the feed roller 87 at the forward front end of the first path 40 so that the downstream side of the opening 81 is formed by the circumference of the feed roller 87. It is therefore possible to reduce the friction to the paper P around the feed roller 87 and prevent scratches and tears thereon.

Next, under a predetermined condition that the cut portion protrudes from the exit slot 90 but is not received within a predetermined time from the protrusion, for example, the drive controller 80 is configured to control the reversible transportation roller assembly 82 to withdraw the cut portion.

Figure 10:
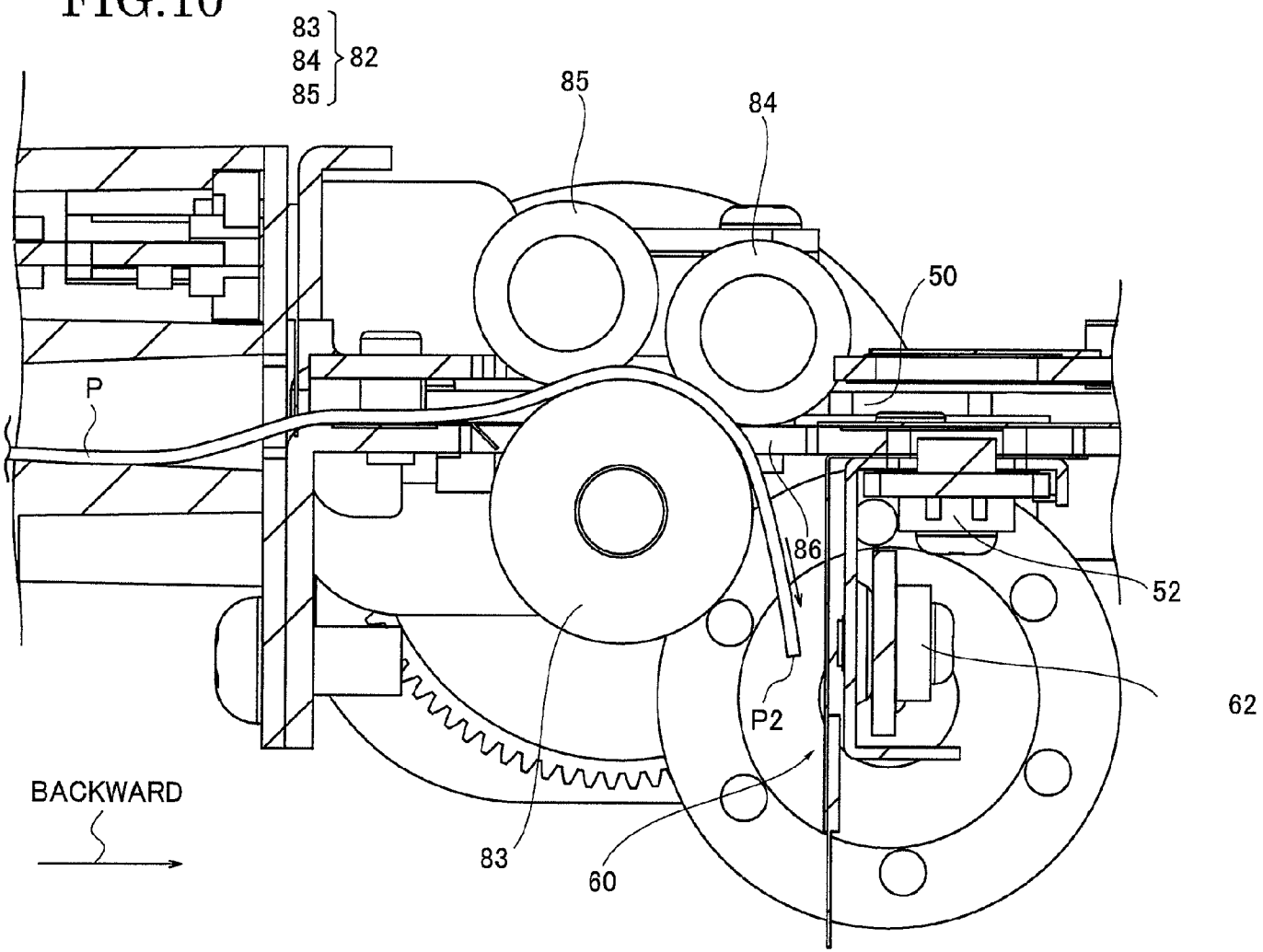
FIG. 10 shows the cut paper portion transported backward while its front end (forward back end) is guided to a third path.

The forward back end (backward front end) P2 of the cut portion is held between the first and second rollers 83, 84 and transported in a direction of the common tangent line L2 of both rollers 83, 84. As shown in FIG. 10, the forward back end P2 is transported to the third path 60 branching downward from the second path 50 through an opening 86 which is in the vicinity of the forward upstream side of the reversible transportation roller assembly 82.

Ahead (downward) of the third path 60, a collection part (not shown) that recovers and stores the paper P is provided inside the paper ejector unit 100. The paper P transported along the third path 60 is sent to this collection part and stored therein.

The paper sensor 62 is provided for the third path 60 to detect the paper P transported on the third path 60 as described above. The drive controller 80 continuously drives the reversible transportation roller assembly 82 backward while the paper sensor 62 is detecting the paper P on the third path 60. When the paper sensor 62 no longer detects the paper P on the third path 60, that is, when no paper P remains thereon since the paper P is completely recovered to the collection part, for example, the drive controller 80 stops driving the reversible transportation roller assembly 82 to end the processing.

As described above, the paper ejector unit 100 according to the present embodiment is configured to control the reversible transportation roller assembly 82 to rotate forward, thereby transporting the paper P to the exit slot 90, and to reversely rotate, thereby transporting the paper P to the third path 60 different from the forward path (the first to second paths 40, 50) for recovery. Because of this, the paper ejector unit 100 can be a simpler mechanism and manufactured at a lower cost than a prior art device having a movable element such as an opening/closing mechanism.

Likewise, it includes the opening 81 with a simpler structure to temporarily retain a loop-down portion of the paper P when forwarding the paper P, compared with a prior art device having a movable element such as an opening/closing mechanism, resulting in reduced manufacture costs.

Moreover, the drive controller 80 is configured to switch the driving state of the reversible transportation roller assembly 82 in accordance with the status of the paper P detected by the paper sensors 52, 62. This enables more reliable driving switching, compared with a simple feed forward control.

Furthermore, in the paper ejector unit 100, the feed roller 87 at the front end of the first path 40 is the one to continuously transport the paper P forward while the paper P is held by the reversible transportation roller assembly 82. Since the opening 81 is provided in the vicinity of the forward downstream side of the feed roller, it is easier to guide the paper P from the circumference of the feed roller 87 to the opening 81 and allow it to loop down.

Further, after the paper P is cut by the cutter 30, restoring force of the loop portion may push the back end P2 of the cut portion to the upstream side. In such a case, the feed roller 87 provided further downstream than the cutter 30 can continue to transport the paper P forward to the opening 81, and prevent the cut portion from being retreated to the upstream side, unlike a prior art device having the feed roller more upstream than the cutter.

In the paper ejector unit 100 according to the present embodiment, the first and second rollers 83, 84 are paired and the first and third rollers 83, 85 are paired. The paper P is transported forward between the rollers 83, 84 toward their common tangent line L2 and the downstream side. Then, it is transported between the first and third rollers 83, 85 toward their common tangent line L1.

The first and third rollers 83, 85 are positioned so that the forward upstream end of the common tangent line faces the exit slot 90. Accordingly, the paper ejector unit 100 can transport the paper P forward to downstream of the common tangent line L1 and to the exit slot 90.

Also, the first and second rollers 83, 84 are positioned so that the forward upstream end of the common tangent line L2 is inclined with respect to the third path 60. The paper ejector unit 100 can accordingly recover the paper P reliably by transporting the paper P backward to the upstream of the common tangent line L2 and to the third path 60.

Furthermore, a single roller—the first roller 83 with a larger diameter than the other two rollers—is paired with the second and third rollers 84, 85 instead of two different rollers. Therefore, the roller assembly configuration can be simplified.

Further, according to the present embodiment, the first roller 83 in contact with the bottom face of the paper P is the single drive roller and the other two rollers 84, 85 are driven rollers. Compared with having two or more drive rollers, it is possible to reduce the number of drive motors (not shown) and simplify the control of the drive controller 80 over the rollers.

Second Embodiment

In the above, the paper ejector unit 100 comprises the reversible transportation roller assembly 82 including three rollers, the first roller 83 as a single drive roller in a large diameter and two driven rollers as the second and third rollers 84, 85 in a small diameter. However, the present invention is not limited to such a configuration. The number of rollers, combinations of drive rollers and driven rollers and the like can be arbitrarily determined.

Figure 11:
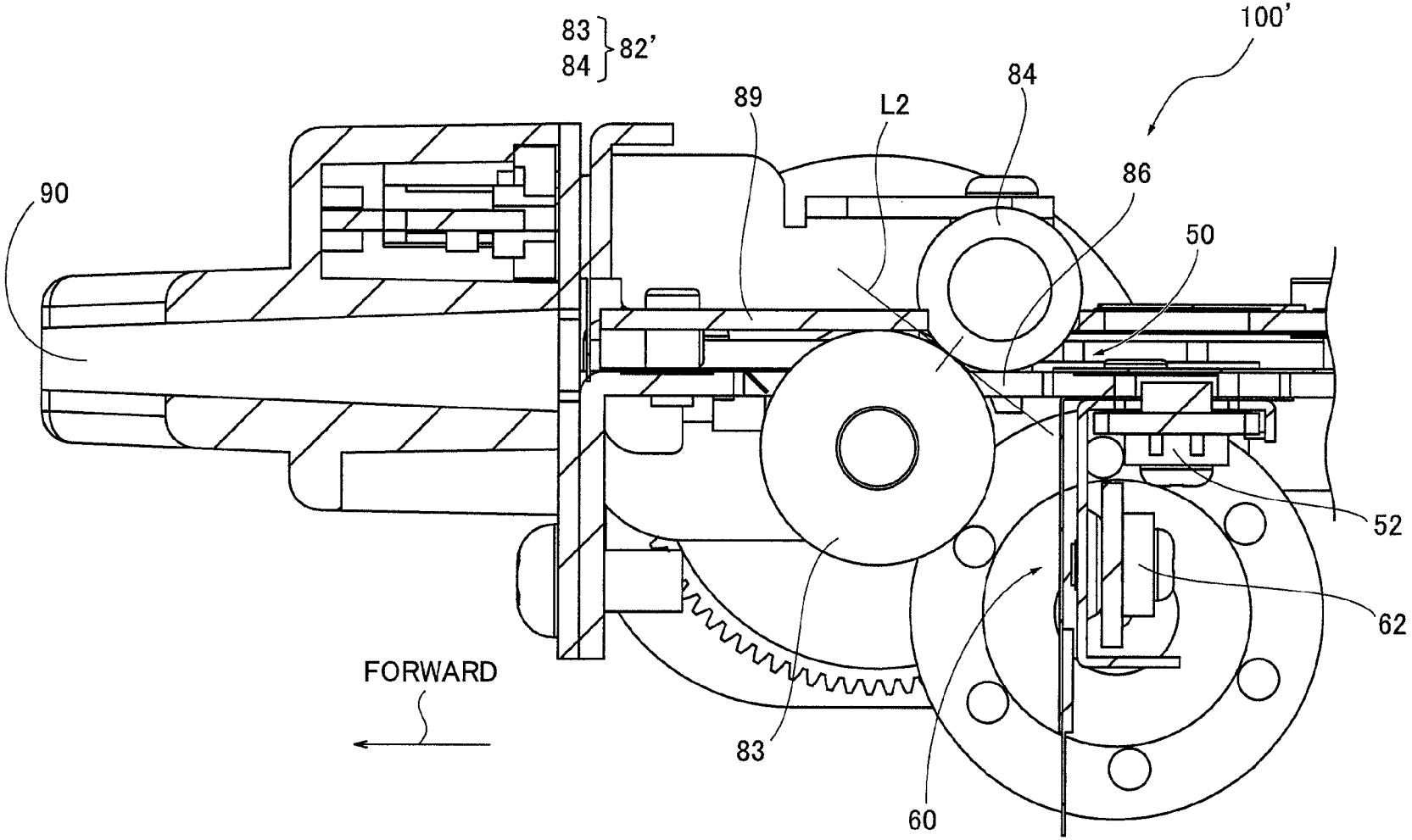
FIG. 11 shows another example of the reversible transportation roller assembly according to a second embodiment of the present invention.

FIG. 11 shows another example of a paper ejector unit 100' comprising a reversible transportation roller assembly 82' which includes two rollers, a first roller 83 as a drive roller in a large diameter and a second roller 84 as a driven roller in a small diameter. The reversible transportation roller assembly 82' excludes the third roller 85 unlike the assembly 82 in FIGS. 1 to 10.

The first and second rollers 83, 84 of the reversible transportation roller assembly 82' are positioned so that the upstream side of their common tangent line L2 is inclined with respect to the third path 60. Therefore, the forward downstream side of the common tangent line L2 does not face the exit slot 90.

The paper ejector unit 100 according to the first embodiment can reliably transport the front end P1 of the paper P forward to the exit slot 90 from the downstream of the reversible transportation roller assembly 82 since the first and third rollers 83, 85 are disposed further downstream than the second roller 84, and the upstream side of the common tangent line L1 of the first and third rollers 83, 85 faces the exit slot 90. Without the third roller 85, the paper ejector unit 100' according to the second embodiment may not be able to direct the front end P1 of the paper P to the exit slot 90 reliably.

In order to prevent this from occurring, the paper ejector unit 100' is configured to include a guide 89 which is substantially parallel to the second path 50 on the forward downstream side of the common tangent line L2. The guide 89 extends to near the forward downstream side of the first roller and second rollers 83, 84 so that the back end P2 of the cut portion intersects with the downstream end of the common tangent line L2. The front end P1 of the cut portion held between the first and second rollers 83, 84 is moved to the downstream side of the common tangent line L2 and hits the bottom face of the guide 89 to be made horizontal to the guide 89 and moved further by the first roller 83.

Thus, it is made possible to reliably direct the paper P toward the exit slot 90 along the bottom face of the guide 89.

As a length of the paper P from the front end P1 to the contact point of the first and second rollers 83, 84 increases, the front end P1 starts deflecting downward under its own weight. Reaching the top face of the second path 50, the paper P can be moved along the second path 50. Accordingly, even without the guide 89, the paper ejector unit 100' can transport the paper P to the exit slot 90.

The paper ejector unit 100' can be configured without the guide 89 and that is also within the scope of the present invention.

As described above, the paper ejector unit according to one embodiment of the present invention is configured to selectively switch paper transport and temporary paper retainment (standby) without including a movable guide to open/close. In transporting the paper forward, the paper passes through the first path, flows along the inclined face of the guide, and reaches and flows on the second path without looping down in the opening. Meanwhile, for temporarily retaining the paper, when the reversible transportation roller assembly stops operating, holding the tip of the paper, the back side of the paper starts deflecting and loops down in the opening.

According to one embodiment of the present invention, the type of printing can be any one of thermal-transfer printing, dot-impact printing, and inkjet printing.

In the paper ejector unit according to one embodiment of the present invention, the paper is transported forward on the first path and guided to the second path by its own weight since the second path is provided at a lower position than the first path. Then, the front end of the paper reaches the reversible transportation roller assembly in the middle of the second path and is held by the reversible transportation roller assembly. Although the reversible transportation roller assembly stops operating, the paper is continuously transported from the back and a paper portion at an upstream area of the assembly starts deflecting. Since the inclined face of the guide restricts the paper from deflecting upward, the paper portion is looped down in the opening provided at the forward front end of the second path. Thus, the paper ejector unit can temporarily retain even a long length of a printed paper inside without an edge of the printed paper exposed outside the exit slot.

The paper ejector unit according to one embodiment of the present invention can selectively switch between paper transport and temporary paper retainment without a movable guide to open/close.

Further, under a certain condition that an end portion of the paper is cut, for example, the reversible transportation roller assembly resumes the forward paper transport to the exit slot. Along with transporting the cut portion forward on the second path, the loop-down of the cut portion is resolved and the front end thereof protrudes from the exit slot.

Meanwhile, under another condition that the cut portion is not received within a predetermined time from the protrusion, for example, the reversible transportation roller assembly withdraws the cut portion, and guides it to the third path provided in the vicinity of the forward upstream (backward downstream) side of the reversible transportation roller assembly for recovery.

As described above, the paper ejector unit according to one embodiment of the present invention is configured to transport the paper to the exit slot by the forward rotation of the reversible transportation roller assembly, and guide it to the third path as a different path from the forward paths for recovery by the reverse rotation of the reversible transportation roller assembly. Therefore, compared with a prior art device having a movable element as an opening/closing mechanism on the paper path, it can be more simply structured and manufactured at lower cost.

Likewise, the paper ejector unit is structured with a simple opening to temporarily retain a portion of the paper in a loop-down state when transporting the paper forward. Compared with a prior art device having a movable element as an opening/closing mechanism, it can be manufactured at lower cost.

In the paper ejector unit according to one embodiment of the present invention, preferably, the cutter is provided in the middle of the first path, the feed roller is provided at the forward front end of the first path and further downstream than the cutter, and the opening is provided in the vicinity of the downstream side of the feed roller.

The thus-configured paper ejector unit can easily guide the paper from the circumference of the feed roller to the opening and allow the paper to loop down in the opening.

Furthermore, the feed roller provided further downstream than the cutter can prevent a paper portion cut by the cutter from returning to the upstream side due to a restoring force of a loop-down portion by continuously transporting the paper forward to the opening. Thus, it is possible for the paper ejector unit to prevent the back end of the cut paper portion from returning to the upstream side, unlike a prior art device.

Further, the paper ejector unit according to one embodiment of the present invention preferably comprises the friction reduction part on the forward edge of the second path. The friction reduction part can be structured in different forms such as the arc-like curvature R, an element having an edge portion with property to reduce friction, or an element having a back end with property to reduce friction and having an arc-like curvature at the edge.

When the reversible transportation roller assembly resumes transporting the paper forward, a portion of the paper looping down in the opening gets in contact with the friction reduction part provided at the back end of the second path to reduce friction to the paper. The friction reduction part can accordingly prevent the paper from scratched or torn.

Moreover, by providing the feed roller at the forward front end of the first path, a paper portion near the downstream side of the opening flows along the circumference of the feed roller. This can also reduce friction therebetween and prevent the paper from being scratched or torn.

Further, in the paper ejector unit according to one embodiment of the present invention, the first and second rollers of the roller assembly are paired and the paper is transported between both of the rollers toward their common tangent line.

Although the downstream side of the common tangent line is not directed to the exit slot, the front end of the paper starts deflecting downward by its own weight and is then transported to the second path or forcibly returned to the second path by the guide and transported along the second path to the exit slot.

Meanwhile, the upstream side of the common tangent line is inclined with respect to the third path. Because of this, for retreating the paper, the paper ejector unit can transport the paper to the third path from the upstream side of the common tangent line and recover the paper without fail.

In the paper ejector unit of one embodiment of the present invention, the first and second rollers as well as the first and third rollers are paired. Therefore, the paper can be transported forward between the first and second rollers in a direction of their common tangent line downstream and then transported between the first and third rollers in a direction of their common tangent line.

Accordingly, the paper ejector unit can transport the paper to the exit slot from the downstream side of the common tangent line of the first and third rollers since the first and third rollers are positioned so that the downstream side of the common tangent line faces the exit slot.

For withdrawing the paper, the paper ejector unit can transport the paper from the forward upstream side of the common tangent line of the first and second rollers to the third path and recover the paper without fail.

Moreover, the second and third rollers are each paired with a single roller (the first roller) not with two separate rollers, which can simplify the roller assembly configuration.

Further, only the first roller contacting the bottom face of the paper is set to the drive roller and the other two (second and third) rollers are the driven rollers. This makes it possible to reduce the number of drive motors for the rollers, compared with two or more drive rollers provided.

According to one embodiment of the present invention, the paper ejector unit comprises the paper sensors on the second and third path respectively to detect the paper passing along the paths. The reversible transportation roller assembly is controlled to rotate in accordance with a state of the paper detected by the paper sensor.

Because of this, the driving state of the reversible transportation roller assembly can be reliably switched in accordance with a state of the paper detected by the paper sensors.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A paper ejector unit which transports a printed paper to an exit slot along a paper path, comprising:

the paper path comprising a first path, a second path provided in a lower position than the first path, and a guide provided between the first and second paths and including an inclined face to restrict an upward deflection of the paper when the paper is transported forward to the exit slot;

a reversible transportation roller assembly in the middle of the second path, the reversible transportation roller assembly being configured to be rotated forward to transport the paper forward to the exit slot, to be reversely rotated to withdraw the paper having been transported to the exit slot, and to stop rotating to stop transporting the paper;

an opening formed downward at a forward back end of the second path, the opening being located and configured so as to guide the paper to loop downwardly for temporary retainment when the reversible transportation roller assembly stops transporting the paper; and a third path branching downward from the second path and provided in the vicinity of a forward upstream side of the reversible transportation roller assembly in order to recover the paper.

2. A paper ejector unit according to claim 1, further comprising:

a cutter in the middle of the first path to cut the paper; and a feed roller provided at a front end of the first path and further downstream than the cutter, to transport the paper forward, wherein the opening is provided in the vicinity of a forward downstream side of the feed roller.

3. A paper ejector unit according to claim 1, further comprising a friction reduction part in a periphery of a forward back end of the second path to reduce friction.

4. A paper ejector unit according to claim 1, wherein:

the reversible transportation roller assembly includes a first roller for contacting a bottom face of the paper and a second roller for contacting a top face of the paper;

the first and second rollers are positioned so that a forward upstream side of a common tangent line of the first and second rollers is inclined towards the third path.

5. A paper ejector unit according to claim 1, wherein:

the reversible transportation roller assembly includes a first roller for contacting a bottom face of the paper, and a second roller and a third roller both for contacting a top face of the paper;

the third roller is provided further downstream in the forward direction than the second roller; and the first and third rollers are positioned so that a forward downstream side of a common tangent line of the first and third rollers faces the exit slot; and the first and second rollers are positioned so that a forward upstream side of a common tangent line of the first and second rollers is inclined towards the third path.

6. A paper ejector unit according to claim 1, further comprising paper sensors provided on the second and third paths, respectively, to detect the paper passing on the second and third paths, wherein the reversible transportation roller assembly is controlled to rotate in accordance with a state of the paper detected by the paper sensors.

7. A paper ejector unit according to claim 1, wherein the second path is arranged in series with the first path and is located at a forward front end of the first path.

8. A paper ejector unit according to claim 7, wherein the opening is permanently located between the forward front end of the first path and the forward back end of the second path.

9. A paper ejector unit according to claim 1, wherein the opening is permanently located between a forward front end of the first path and the forward back end of the second path.

10. A paper ejector unit according to claim 1, wherein the guide is located above the opening.

11. A paper ejector unit according to claim 1, wherein the reversible transportation roller assembly includes a first roller for contacting a bottom face of the paper and a second roller for contacting a top face of the paper;

the first and second rollers are positioned so that a forward upstream side of a common tangent line of the first and second rollers is downwardly inclined towards the third path.

12. A paper ejector unit according to claim 1, further comprising a friction reduction part extending in a forward upstream direction from a forward back end of the second path, the friction reduction part having a forward back end with a downwardly-bent, arc-shaped curvature.

13. A paper ejector unit according to claim 1, wherein the guide extends over the first and second paths, and is configured to restrict an upward deflection of the paper over the first path, the opening, and the second path when the paper is transported forward to the exit slot.

14. A paper ejector unit according to claim 1, further comprising a friction reducing part located between the opening and the third path.

* * * * *